US005236200A

United States Patent [19]

McGregor et al.

[11] Patent Number: 5,236,200

[45] Date of Patent: Aug. 17, 1993

[54] CARD-LIKE STRUCTURE

[76] Inventors: Dennis L. McGregor; Marcie L. McGregor, both of 345 E. Cascade, Sisters, Oreg. 97759

[21] Appl. No.: 886,647

[22] Filed: May 20, 1992

[51] Int. Cl.[5] ..... A63F 1/02; B42D 15/04

[52] U.S. Cl. ..... 273/459; 273/296; 283/49; 283/903

[58] Field of Search ..... 273/459, 139, 254, 296; 283/903, 117, 49

[56] References Cited

U.S. PATENT DOCUMENTS

| | | | |
|---|---|---|---|
| 2,279,164 | 4/1942 | Gettleman | 283/117 X |
| 2,635,881 | 4/1953 | Cooney . | |
| 2,876,012 | 3/1959 | Allen, Jr. | 273/139 |
| 3,517,947 | 6/1970 | Bennett . | |
| 4,010,964 | 3/1977 | Schechter . | |
| 4,601,490 | 7/1986 | Brandon . | |
| 4,685,699 | 8/1987 | Hirasawa . | |
| 4,838,580 | 6/1989 | Tuhkanen . | |
| 4,907,826 | 3/1990 | Versage . | |
| 5,125,689 | 6/1992 | Heninger | 273/139 X |

FOREIGN PATENT DOCUMENTS

| | | | |
|---|---|---|---|
| 0219699 | 9/1990 | Japan | 283/117 |

*Primary Examiner*—V. Millin
*Assistant Examiner*—Raleigh W. Chiu
*Attorney, Agent, or Firm*—Kolisch, Hartwell, Dickinson, McCormack & Heuser

[57] ABSTRACT

A card-like structure facilitating the setup and playing of a treasure hunt-like game is disclosed. In a preferred embodiment, the structure takes the form of a pre-printed, multi-folded greeting card including a sheet portion having easily detachable elements. Each element is pre-printed on one side in large print with task-setting messages, or locational clues, for the intended gift recipient, and on the other side in smaller print with instructional messages, or placement instructions, for the gift giver. The clues and instructions are related in a predefined way so that elements properly placed by the gift giver in accordance with the instructions may be found by and will lead the recipient to a gift properly placed by the gift giver. Preferably, a first task-setting message, or clue, and an enticing greeting are printed on the portion of the greeting card that remains after the plural elements are dispensed from the game card system or structure. A preferred method of laying out a blank for printing and perforation, and the structure resulting therefrom, also are disclosed.

10 Claims, 2 Drawing Sheets

CARD-LIKE STRUCTURE

BACKGROUND OF THE INVENTION

The present invention relates generally to greeting cards games such as treasure hunts. More particularly, the invention concerns a card-like structure that enables the playing of a treasure hunt game wherein various clues are preprinted on detachable elements formed integrally with a greeting card.

Promotional structures are known that include paper stock having printed on one side thereof reproductions suitable for framing and having printed on the other side thereof promotional and advertising information and that also include paper stock having printed and die-stamped thereon detachable coupons. Such structures are thought to provide an incentive to users to view the reproductions, to read the promotional information and hopefully to redeem the coupons for valuable goods or services related to the promotional material. One such structure is described by Hirasawa in U.S. Pat. No. 4,685,699 entitled "Promotional Article", issued Aug. 11, 1987.

Known participative games include so-called treasure hunts in which clues are planted at various physical locations, with each clue at least hinting at the location of the next, and with the last clue at least hinting at the location of a prize or token. Such games depend upon the skill and cleverness of a person who might be referred to as a hider of the treasure—who also typically formulates and places the clues—and (2) the comprehension and perseverance of a person who might be referred to as a seeker of the treasure—who also typically deciphers and locates the clues.

It is desirable to provide a self-contained printed version of a treasure hunt-type of game in a structural form that facilitates clue placement and retrieval, and in an aesthetic form that encourages play. It also is desirable to provide such a game in an integral form, e.g. a card, that is organized to assist a gift giver in clue hiding or placement and to assist a gift recipient in clue seeking or retrieval, thereby to enhance gift-giving and gift-receiving pleasure. It also is desirable to provide such a treasure hunting game in an easily and inexpensively manufactured form that is flat and resembles a greeting card.

SUMMARY OF THE INVENTION

The present invention is a card-like structure, or game card system, that enhances the gift-giving and gift-receiving pleasure by making a game of it. In a preferred embodiment, the invention takes the form of a pre-printed, multi-folded greeting card including a sheet portion having easily detachable elements. Each element is pre-printed with task-setting messages, or locational clues, for the gift recipient on one side in large print and with instructional messages, or placement instructions, for the gift giver on the other side in smaller print. The clues and instructions are related in a predefined way so that elements properly placed by the giver in accordance with the instructions may be found by and will lead the recipient to a gift properly placed by the giver. Preferably, a first task-setting message, or clue, and an enticing greeting are printed on the portion of the greeting card that remains after the plural elements are dispensed from the game card system or structure. No longer must the gift giver devise his or her own clues and treasure map; nor is the treasure hunt-like game subject to a confusing or failing sequence of instructions or hunting techniques. Instead, clue placement is predefined by easy-to-follow instructions, and the easy-to-follow clues present a sure road map to hidden treasure.

These and additional objects and advantages of the present invention will be more readily understood after a consideration of the drawings and the detailed description of the preferred embodiment.

DETAILED DESCRIPTION OF THE PREFERRED EMBODIMENT

Figure 1:
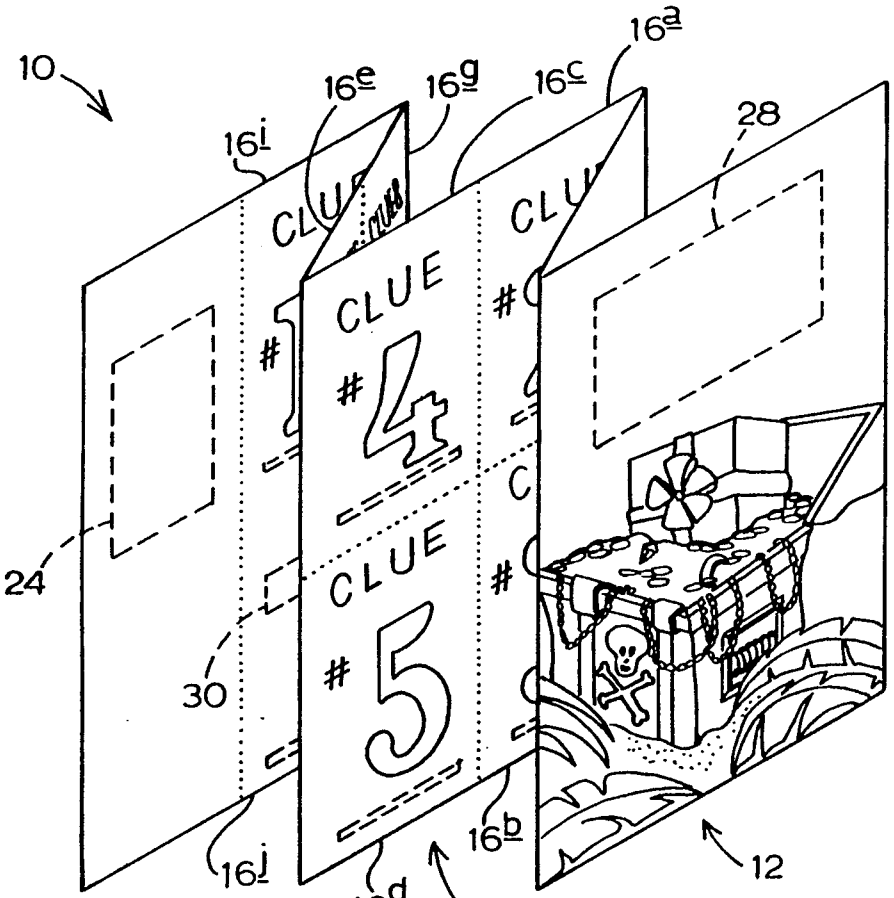
FIG. 1 is an isometric view of the card-like structure of the invention made in accordance with its preferred embodiment and depicted in a folded condition.
Figure 4A:
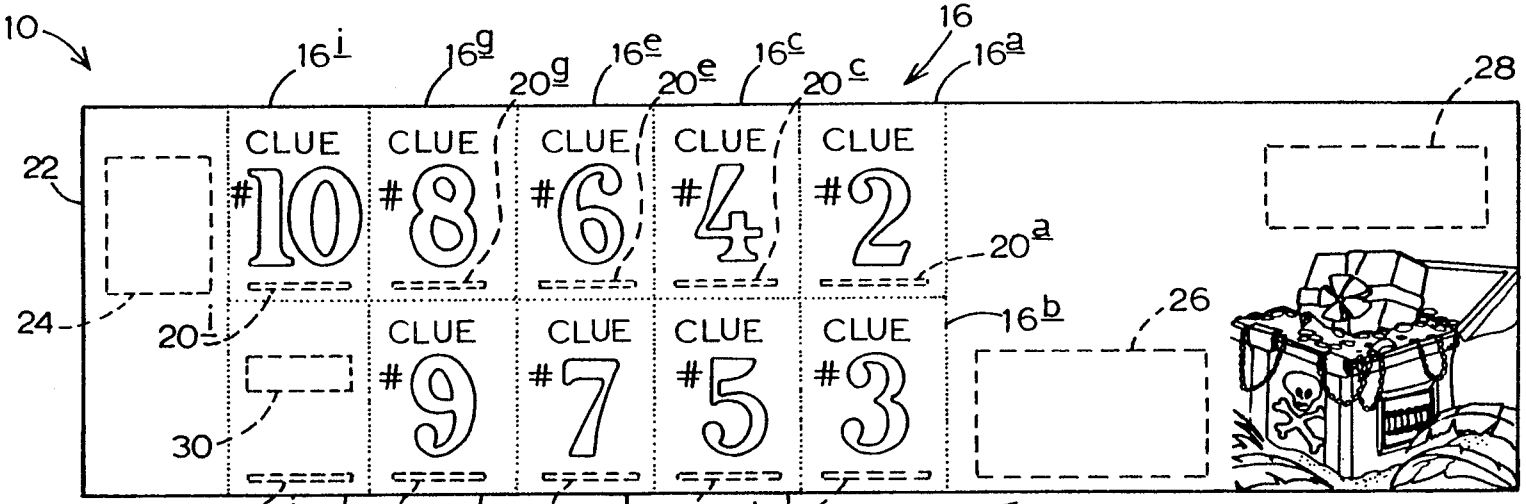
FIGS. 4A and 4B respectively are a front and rear elevation of the structure corresponding with FIG. 1, but illustrating the blank layout and printing and perforating steps of the preferred method of its manufacture.
Figure 4B:
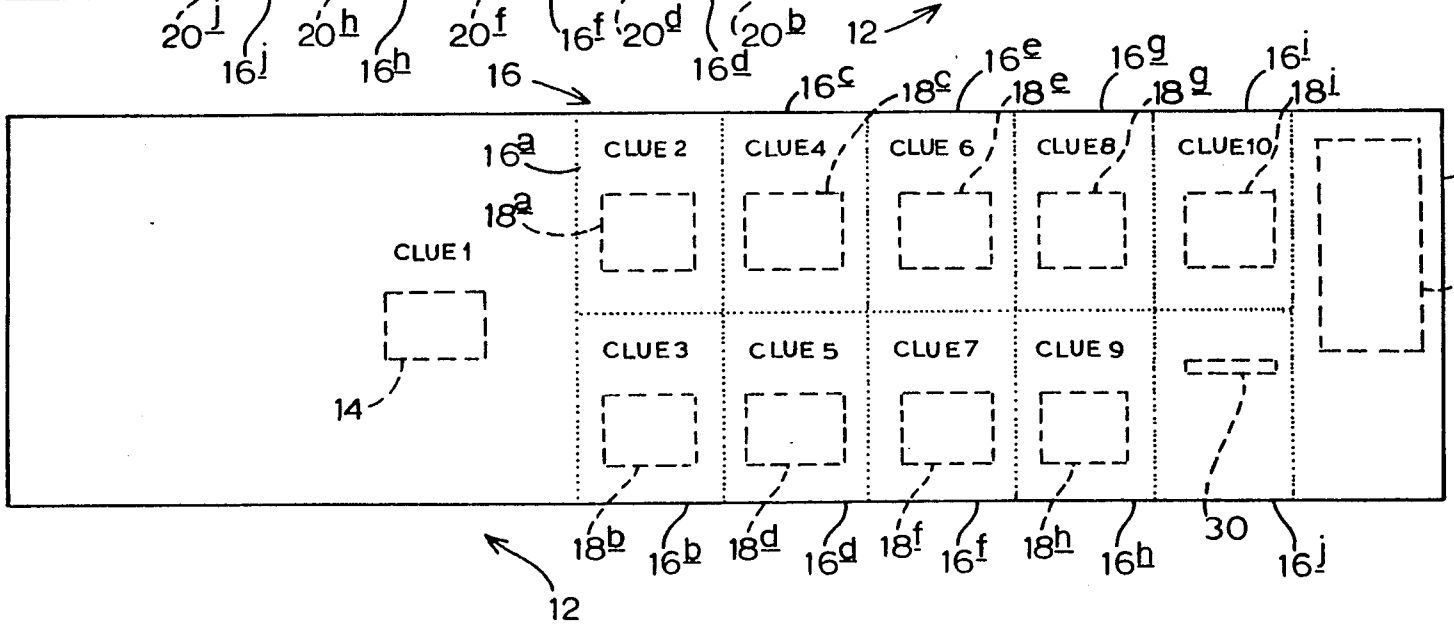

Referring first to FIGS. 1 and 4A–4B, the card-like structure, or game card-system, or so-called task-setting card, made in accordance with its preferred embodiment is indicated at 10. Structure or card 10 preferably includes a first relatively thin flat sheet portion 12 containing a task-setting message such as a clue, indicated at dashed outline box 14 (FIG. 4B), and a second thin flat sheet portion 16 removably connected therewith. As may be seen from FIG. 1, card 10 may be fan folded, accordion style, for compact packaging as is conventional with greeting cards. As will be seen by reference below to FIGS. 4A and 4B, card 10 preferably is formed of relatively thin stiff paper or cardboard stock from a single blank, which may be die cut to form perforations (indicated in the drawings by dotted lines) for the easy removal of second sheet portion 16 from first sheet portion 12.

Referring now collectively to FIGS. 1, 2A–2B, and 4A–4B second sheet portion 16 may include plural, preferably regularly arrayed, detachable subsheet elements **16*a*, 16*b*, 16*c*, 16*d*, 16*e*, 16*f*, 16*g*, 16*h*, 16*i*, 16*j*. Each element is removably connected with two or more others, e.g. element 16*a* is connected with elements 16*b*, 16*c* and element 16*c* is connected with elements 16*a*, 16*d*, 16*e*. Plural ones of the elements, e.g. preferably all but element 16*j*, contain second task setting messages such as clues, e.g. clues 18*a*, 18*b*, 18*c*, 18*d*, 18*e*, 18*f*, 18*g*, 18*h*, 18*i* preferably being preprinted on the front sides thereof. At least one such detachable subsheet element, and preferably all of them, further contain an instructional message, e.g. instructional messages 20*a*, 20*b*, 20*c*, 20*d*, 20*e*, 20*f*, 20*g*, 20*h*, 20*i*, 20*j*** preferably being preprinted on the rear sides thereof.

Importantly, instructional messages such as message **20*b* of a given element such as element 16*b* are related to a corresponding task-setting message contained on another of the elements such as message 20*a* of element 16*a*. An example of this relationship between corresponding instructional and task-setting messages follows with respect to elements 16***a*, 16*b*. Element 16*a* might contain on its front side an entertaining depiction of an animated frying pan, and a task-setting message or clue "PAN." Element 16*b* might contain on its rear side an instructional message 20*b* "(Place under pan.)" Clearly and simply, when a gift giver hides element 16*b*, it should be placed under a frying pan, for example, in the kitchen. It will be understood that the task-setting message or clue 18*b* preprinted on the front side of element 16*b* would contain the next in a sequence of task-setting messages or clues.

Task-setting message as used herein most broadly means any indicium or indicia intended to and capable of conveying an ideal or goal. Such may comprise symbols, anagrams, words, phrases, puzzles, graphics, pictures or any combination thereof. Preferably, the task-setting messages contained on structure 10 are visual clues regarding the physical location of another clue or of a hidden treasure, gift or token, and they preferably take the form of one or more words and an accompanying illustration that alone or in combination suggest such location. Within the spirit of the invention, the task-setting messages may take alternative forms, e.g. an element might have a tactile or scratch-and-sniff region or an imbedded vocal or musical record the feel of or emanations from which hint at a next hiding place.

Figure 2B:
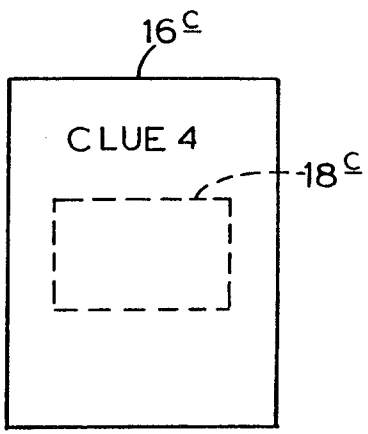
FIGS. 2A and 2B respectively are front and rear elevations of one of the detachable elements that form a part of the structure shown in FIG. 1.
Figure 2A:
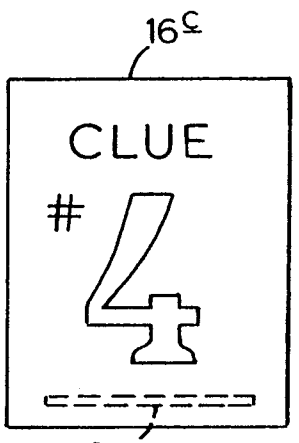

Focusing briefly now on FIGS. 2A and 2B, the front and back of dispensed element 16*c* is shown as being typical of all such elements except for the last to be hidden with the treasure, gift or token, namely element 16*j* (which need contain no task-setting message, but instead might say, very simply, "Congratulations!"). Instructional message 20*c* contained on the front side of element 16*c* underneath the prominently printed clue number, the instructional message being indicated in FIG. 2A by a dashed outline box, might say ("Place under couch.)". Task-setting message 18*c* contained on the rear side of element 16*c* underneath the prominent printed picture of an animated clock, the task-setting message being indicated in FIG. 2B by a dashed outline box, might say "Clock." As will be clear now, task-setting message 18*b* contained on the rear side of element 16*b* might say "couch", thus giving a clue as to where element 16*c* might be found.

Other dispensed elements (not shown for the sake of simplicity) preferably would be lain out similarly, but of course would contain different clue numbers and instructional and task-setting messages, as described above in reference to FIGS. 1, 2A and 2B. Myriad task-setting messages and corresponding instructional messages, as well as myriad graphic themes may be incorporated in game card system 10 such that each structure 10 constitutes not only a different greeting and sentiment, but also a different and exciting game of treasure hunt. It will be understood that the task-setting messages, or clues, may be made more subtle and difficult if the intended recipient is an adult, and may be made even more explicit and easily comprehended if the intended recipient is a child.

Figure 3B:
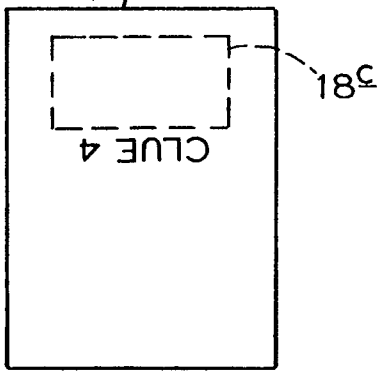
FIGS. 3A and 3B respectively are front and rear elevations of a detachable element like that of FIGS. 2A and 2B, except they show a proposed folded modification thereto.
Figure 3A:
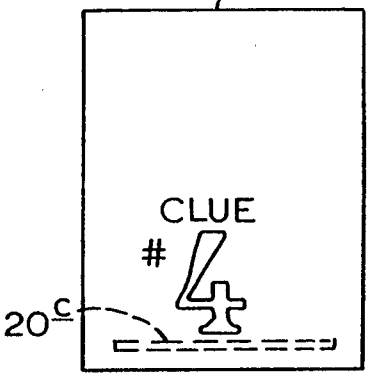

Turning briefly to FIGS. 3A and 3B, dispensed element 16*c* is shown as representing a modified, foldable embodiment containing identical functional features with element 16*c* but a slightly different printed form that permits it to be folded and to be placed in a stand-up, A-frame configuration. Those of skill in the art will appreciate that the different locations on the front and back of the element, shown respectively in FIGS. 3A and 3B, of the printed matter represents the only difference from the preferred embodiment described by reference to FIGS. 2A and 2B, and such differences are clearly shown and thus will not be described herein.

Referring finally to FIGS. 4A and 4B, the two sides of a printed and die-cut blank are used to illustrate the preferred method by which game card system 10 is manufactured. As may be seen, manufacture is a simple and inexpensive process of printing two different pieces of artwork on the two sides of a blank of flat, stiff paper stock in such manner that corresponding, preferably numbered, dispensable element images are on opposite sides of the blank, and then die cutting the blank to form the perforations that permit the elements of second sheet 16 quickly and easily to be separated from one another and from first sheet 12. Multi-colored, offset printing has been found to produce a professional looking and pleasing game card system. During the die-stamping operation, optionally equally laterally spaced vertical lines may be scored to facilitate folding of game card system 10 into the accordion form shown in FIG. 1. Also shown in FIGS. 4A and 4B is an optional, dispensable, filler element 22, which may be printed with one or more additional, general instructional messages indicated by dashed outline box 24 to the gift giver. FIGS. 4A and 4B also illustrate an optionally printed region indicated by a dashed outline box 26 on what (after folding) becomes the back of the greeting card portion. Region 26 might contain the name and address of the manufacturer of game card system 10 and associated graphics. Finally, FIGS. 4A and 4B illustrate an optional, but preferable, printed greeting region indicated by a dashed outline box 28 and associated graphics on the front of greeting card portion, or first sheet 12, as well as the above-described final, preferably laudatory (e.g. congratulatory) message indicated by a dashed outline box 30 on the front and rear of the last-dispensed element 16*j*.

Persons skilled in the art will appreciate now that at least two, and preferably all successive pairs, of plural elements 16 are related to one another in the following way: A first one of second task-setting messages, e.g. task-setting message 18*b*, contained on a first one of the elements, e.g. element 16*b*, indicates a physical location, e.g. the "couch", where a second one of the elements, e.g. element 16*c*, is intended to be placed upon its detachment. Preferably, a second one of the elements, e.g. element 16*c*, contains an instructional message, e.g. instructional message 20*c*, which instructional message indicates such physical location, e.g. "place under couch."

Preferably, substantially all of plural elements 16 contain one of the task-setting messages and one of the instructional messages (typically last-in-succession element 16*j* contains no task-setting message, but instead represents the rewarding culmination of the succession of tasks such as the described treasure-hunting steps). As may be seen, preferably each of the task-setting messages contained on a given element, e.g. task-setting message 18*b* of element 16*b*, is related to a corresponding one of the instructional messages contained on another element, e.g. instructional message 20*c* of element 16*c*.

In accordance with the preferred treasure hunt embodiment of the invention, this relationship involves a printed indication—whether subtle or explicit—within each of such corresponding messages of a physical location where the given element is intended to be placed upon its detachment. As best shown in FIGS. 2A and 2B (or 3A and 3B), a second one of second task-setting messages 18 is contained on a first, or front, side of the second one of plural elements 16, with one of instructional messages 20 contained on a second, or rear, side thereof. Briefly summarizing the preferred embodiment of the invention, plural task-setting messages 18 are in the nature of clues regarding the whereabouts of a gift for a seeker, and each of preferably plural instructional messages 20 indicates a physical location where the element containing such instructional message is intended to be placed by a hider.

Another way of describing the invention focuses on the combined treasure hunt and greeting card structure of game card system 10. Such combination may be seen best from FIGS. 4A and 4B to include a two-sided, pre-printed blank which includes two or more separable parts a first one 12 of which contains a greeting 28 and a first locational clue 14 and a second one 16 of which contains on one side thereof a second clue 18*a* and on another side thereof an instruction 20*a* regarding locational placement thereof that corresponds with first clue 14. Clearly, from FIGS. 4A and 4B, it is preferable that such combination includes more than one such second separable parts or so-called sub-parts, e.g. dispensable elements 16*a*, 16*b*, 16*c*, 16*d*, 16*e*, 16*f*, 16*g*, 16*h*, 16*i*, 16*j*, each containing one in a succession of such clues on a first side thereof and each but the last one of which contains one of a succession of instructions on the other side regarding placement thereof, wherein the instruction corresponds with a clue contained on one side of another one of the separable sub-parts. Of course, more or fewer than the illustrated number of clues and instructions are contemplated and are within the spirit of the invention.

As is shown in the drawings, such plural separable sub-parts, or dispensable elements, 16 preferably further contain sequence indicia such as the clue numbers prominently printed thereon. It may be seen that, as between any two successively sequenced sub-parts, e.g. elements 16*a* and 16*b* containing clues numbered 2 and 3, the other, or rear, side of the later sequenced sub-part, e.g. element 16*b*, contains an instruction regarding placement thereof that corresponds with a corresponding clue contained on one, or the front, side of the earlier sequenced sub-part, e.g. element 16*a*. Importantly, it is this sequence-offset instructional and task-setting message configuration that renders each element cooperative with ones earlier and later sequenced in both hiding and seeking clues in the treasure-hunting game.

Finally, game card structure 10 may be described as including a greeting card 12 containing a printed first clue 14 regarding the location of a subsequent clue. Greeting card 12 has removably connectedly appended thereto, plural substructure elements 16*a*, 16*b*, 16*c*, 16*d*, 16*e*, 16*f*, 16*g*, 16*h*, 16*i*, 16*j* substantially each one of which contains one of a succession of printed clues 18*a*, 18*b*, 18*c*. 18*d*, 18*e*, 18*f*, 18*g*, 18*h*, 18*i* regarding the whereabouts of a gift, with each containing one of a succession of instructional messages 20*a*, 20*b*, 20*c*, 20*d*, 20*e*, 20*f*, 20*g*, 20*h*, 20*i*, 20*j* corresponding to the succession of printed clues. Again, as between any two successive clues, the element bearing the later (succeeding) clue in the succession contains an instruction regarding placement thereof that corresponds with a corresponding clue contained on the element bearing the earlier (preceding) clue in the succession. It will be understood that the succession of and resulting relation between any two clues contained in the substructure elements may be merely implied by the clues themselves or other indicia, instead of being expressly numerically presented, thereon.

USE

Game card system 10 is extremely easy to use. The gift giver, who is referred to herein also as the hider thereof, simply removes dispensable elements 16 and follows the instructional messages contained on their reverse sides. The first sheet, or greeting card, portion that remains—after all elements are dispensed and hidden—is then given to the intended gift recipient. In turn, the gift recipient, who is referred to herein also as the seeker thereof, simply follows the clues contained on the front side of each dispensable element. The gift, or treasure, readily is found, much to the pleasure of hider and seeker, much to the joy of giver and receiver.

While the present invention has been shown and described with reference to the foregoing preferred embodiment, it will be apparent to those skilled in the art that other changes in form and detail may be made therein without departing from the spirit and scope of the invention as defined in the appended claims.

What is claimed is:

1. A card-like structure comprising:

a first sheet portion containing a first task-setting message, and a second sheet portion connected with said first sheet portion, said second sheet portion having plural detachable subsheet elements, plural ones of said elements containing second task-setting messages, at least one of said elements further containing an instructional message that is related to one of said second task-setting messages contained on another of said elements.

2. The structure of claim 1, wherein at least two of said plural elements are related to one another such that a first one of said second task-setting messages contained on a first one of said plural elements indicates a physical location where a second one of said plural elements is intended to be placed upon its detachment.

3. The structure of claim 2, wherein said second one of said plural elements contains said instructional message and wherein said instructional message indicates such physical location.

4. The structure of claim 3, wherein a second one of said second task-setting messages is contained on a first side of said second one of said plural elements and wherein one of said instructional messages is contained on a second side thereof.

5. The structure of claim 1, wherein substantially all of said elements contain one of said task-setting messages and one of said instructional messages, and wherein each of said task-setting messages contained on a given element is related to a corresponding one of said instructional messages contained on another element such that corresponding messages indicate a physical location where said given element is intended to be placed upon its detachment.

6. The structure of claim 5, wherein said task-setting messages are in the nature of clues regarding the whereabouts of a gift for a seeker, and wherein said instructional message indicates a physical location where said element containing said instruction message is intended to be placed by a hider.

7. A combined treasure hunt and greeting card structure comprising:

a two-sided pre-printed blank;

said blank including two or more separable parts, a first one of which contains a greeting and a first locational clue, and a second one of which contains on one side thereof a second clue, and on another side thereof an instruction regarding locational placement thereof that corresponds with said first clue.

8. The structure of claim 7, wherein said second one of said parts includes plural separable sub-parts each of which contains on one side thereof a clue, and on another side thereof an instruction regarding locational placement thereof that corresponds with a corresponding clue contained on one side of another one of said separable sub-parts.

9. The structure of claim 8, wherein said separable sub-parts further contain sequence indicia and wherein, as between any two successively sequenced sub-parts, said other side of the later sequenced sub-part contains an instruction regarding placement thereof that corresponds with a corresponding clue contained on said one side of the earlier sequenced sub-part.

10. A game card structure comprising:

a greeting card containing a printed first clue regarding the location of a subsequent clue, said card having removably connectedly appended thereto plural substructure elements substantially all of which contain one of a succession of printed clues regarding the whereabouts of a gift, each element containing one of a succession of instructional messages corresponding to the succession of printed clues, wherein, as between any two successive clues, the element bearing the succeeding clue contains an instruction regarding placement thereof that corresponds with a corresponding clue contained on the element bearing the preceding clue.

* * * * *